US008796927B2

(12) United States Patent
Meinhold

(10) Patent No.: US 8,796,927 B2
(45) Date of Patent: Aug. 5, 2014

(54) PLASMA CELL AND METHOD OF MANUFACTURING A PLASMA CELL

(75) Inventor: Dirk Meinhold, Dresden (DE)

(73) Assignee: Infineon Technologies AG, Neubiberg (DE)

( * ) Notice: Subject to any disclaimer, the term of this patent is extended or adjusted under 35 U.S.C. 154(b) by 247 days.

(21) Appl. No.: 13/366,147

(22) Filed: Feb. 3, 2012

(65) Prior Publication Data

US 2013/0200786 A1 Aug. 8, 2013

(51) Int. Cl.
*H01J 17/49* (2012.01)

(52) U.S. Cl.
USPC ..... 313/582; 313/587; 313/584

(58) Field of Classification Search
USPC ..... 313/582–587
See application file for complete search history.

(56) References Cited

U.S. PATENT DOCUMENTS 5,438,343 A * 8/1995 Khan et al. ..... 445/44
5,990,620 A * 11/1999 Lepselter ..... 313/585
6,016,027 A * 1/2000 DeTemple et al. ..... 313/356
8,004,017 B2 * 8/2011 Eden et al. ..... 313/582
2007/0200499 A1 * 8/2007 Eden et al. ..... 313/582
2008/0129185 A1 * 6/2008 Eden et al. ..... 313/485

FOREIGN PATENT DOCUMENTS

DE 102006018077 A1 11/2006

OTHER PUBLICATIONS

"Plasma display" http://en.wikipedia.org/wiki/Plasma_display; Feb. 3, 2012, pp. 1-12.
Bae, H., et al., "The Effects of Sustain Electrode Gap Variation on the Luminous Efficacy in Coplanar-Type AC Plasma Display Panel Under Low- and High-Xe Content Conditions," IEEE Transactions on Plasma Science, Apr. 2007, 467-472, vol. 35, No. 2.
Shinoda, T., et al., "Low-Voltage Operated AC Plasma-Display Panels," IEEE Transactions on Electron Devices, Aug. 1979, 1163-1167, vol. ED-26, No. 8.
Song, I., et al., "The Effects of Electrode Structures on the Luminous Efficacy of Micro Dielectric Barrier Discharges," IEEE Transactions on Plasma Science, Aug. 2009, 1572-1580, vol. 37, No. 8.

* cited by examiner

*Primary Examiner* — Mariceli Santiago
(74) *Attorney, Agent, or Firm* — Slater & Matsil, L.L.P.

(57) ABSTRACT

A plasma cell and a method for making a plasma cell are disclosed. In accordance with an embodiment of the present invention, a cell comprises a semiconductor material, an opening disposed in the semiconductor material, a dielectric layer lining a surface of the opening, a cap layer closing the opening, a first electrode disposed adjacent the opening, and a second electrode disposed adjacent the opening.

26 Claims, 10 Drawing Sheets

PLASMA CELL AND METHOD OF MANUFACTURING A PLASMA CELL

TECHNICAL FIELD

The present invention relates generally to a plasma cell and a method of making a plasma cell.

BACKGROUND

A plasma display panel (PDP) is common in large TV displays. The plasma display comprises small cells which contain electrically charged ionized gases.

Plasma displays are bright (1,000 lux or higher for the module), have a wide color gamut, and can be produced in fairly large sizes—up to 150 inches (3.8 m) diagonally. The display panel itself is about 6 cm (2.5 inches) thick, generally allowing the device's total thickness (including electronics) to be less than 10 cm (4 inches).

SUMMARY OF THE INVENTION

In accordance with an embodiment of the present invention, a cell comprises a semiconductor material, an opening disposed in the semiconductor material, a dielectric layer lining a surface of the opening, a cap layer closing the opening, a first electrode disposed adjacent the opening, and a second electrode disposed adjacent the opening.

In accordance with an embodiment of the present invention, a panel comprises a semiconductor material, and a plurality of cells, wherein each cell comprises an opening disposed in the semiconductor material, a dielectric layer lining a surface of the opening, a cap layer sealing the opening, a first electrode disposed adjacent the opening, and a second electrode disposed adjacent the opening.

In accordance with an embodiment of the present invention, a method for manufacturing a semiconductor device comprises forming an opening in a semiconductor material, lining the opening with a dielectric layer, closing the opening with a cap layer, forming a first electrode adjacent the opening, and forming a second electrode adjacent the opening.

BRIEF DESCRIPTION OF THE DRAWINGS

For a more complete understanding of the present invention, and the advantages thereof, reference is now made to the following descriptions taken in conjunction with the accompanying drawing, in which.

DETAILED DESCRIPTION OF ILLUSTRATIVE EMBODIMENTS

The making and using of the presently preferred embodiments are discussed in detail below. It should be appreciated, however, that the present invention provides many applicable inventive concepts that can be embodied in a wide variety of specific contexts. The specific embodiments discussed are merely illustrative of specific ways to make and use the invention, and do not limit the scope of the invention.

The present invention will be described with respect to embodiments in a specific context, namely a semiconductor plasma cell. The invention may also be applied, however, to other types of plasma cells.

A panel typically has millions of tiny cells in compartmentalized space between two panels of glass. These compartments or cells hold a mixture of noble gases and a minuscule amount of mercury. Just as in the fluorescent lamp, when the mercury is vaporized and a voltage is applied across the cell, the gas in the cells forms a plasma. With flow of electricity (electrons), some of the electrons strike mercury particles as the electrons move through the plasma, momentarily increasing the energy level of the molecule until the excess energy is shed. Mercury emits energy as ultraviolet (UV) photons.

The UV photons then strike phosphor that is disposed on the inside of the cell walls. When the UV photon strikes a phosphor molecule, it momentarily raises the energy level of an outer orbit electron in the phosphor molecule, moving the electron from a stable to an unstable state. The electron then emits the excess energy as a photon at a lower energy level than UV light. The lower energy photons are mostly in the infrared range but about 40% are in the visible light range. Thus the input energy is emitted partially as visible light.

Depending on the phosphors used, different colors of visible light can be emitted. Each pixel in a plasma display is made up of three cells comprising the primary colors of visible light. Varying the voltage of the signals to the cells thus allows different perceived colors.

Figure 1:
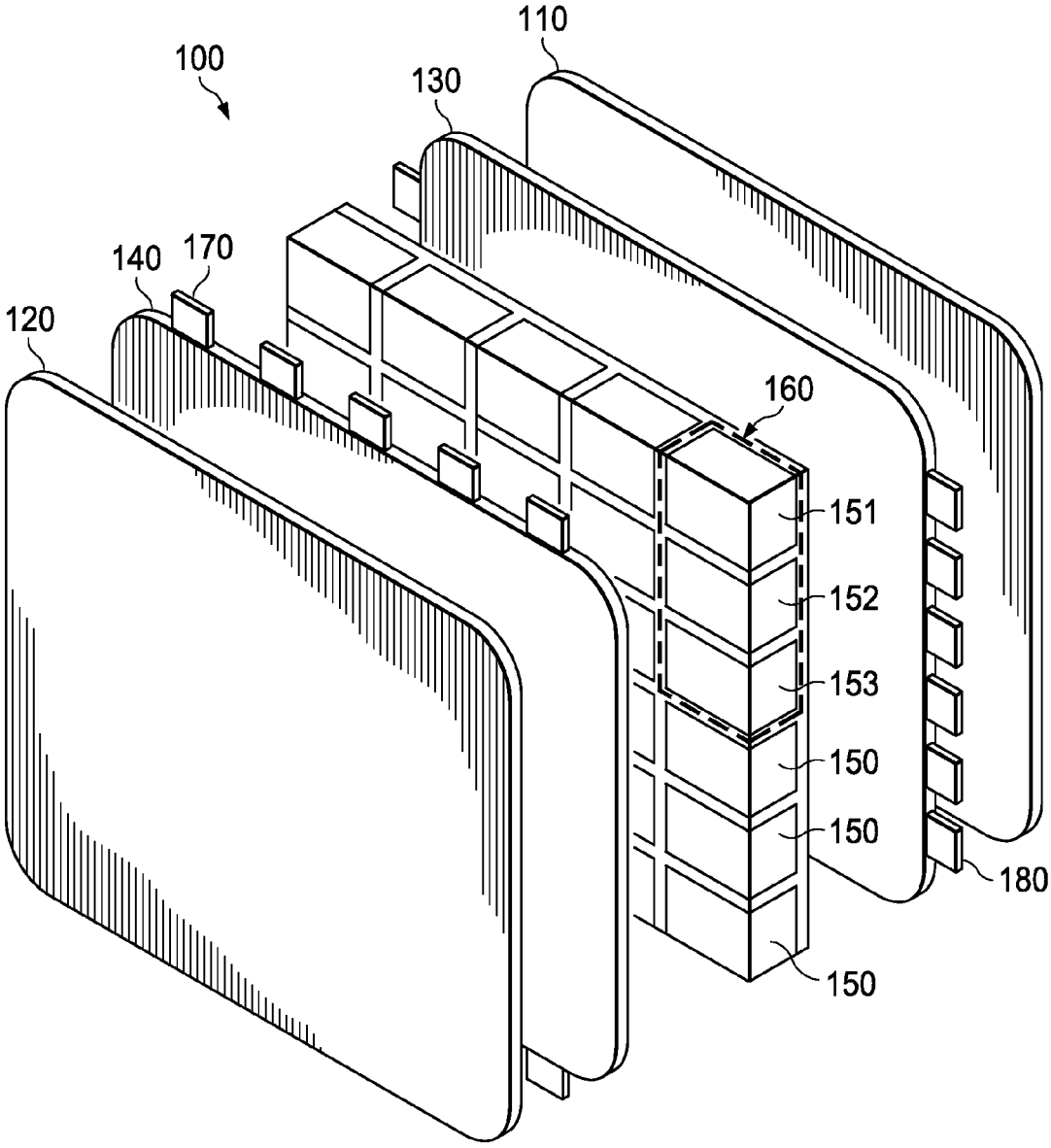
FIG. 1 shows a plasma display composition.

A plasma display panel is an array of hundreds of thousands of small, luminous cells positioned between two plates of glass. Each cell is filled with an inert gas such as helium (He), neon (Ne), xenon (Xe), argon (Ar), other inert gases, or combinations thereof. The cells are luminous when they are electrified through electrodes. FIG. 1 shows a perspective plasma display composition 100.

The plasma display composition 100 shows a rear glass plate 110 and a front glass plate 120. Two dielectric layers 130 and 140 are disposed between the front glass plate 120 and the rear glass plate 110. Individual plasma cells 150 are arranged between the two dielectric layers 130, 140. For example, three plasma cells 151-153 form a pixel 160.

The long electrodes 170, 180 may be stripes of electrically conducting material that also lie between the glass plates 110, 120, in front of and behind the cells 150. The address electrodes 180 may sit behind the cells 150, along the rear glass plate 110, and may be opaque. The transparent display electrodes 170 are mounted in front of the cell 150, along the front glass plate 120. As can be seen in FIG. 1, the electrodes 170, 180 are covered by an insulating protective layer 130, 140. Control circuitry charges the electrodes 170, 180 that cross paths at a cell, creating a voltage difference between front and back. Some of the atoms in the gas of a cell then lose electrons and become ionized, which creates an electrically conductive plasma of atoms, free electrons, and ions. Such light-emitting plasmas are known as glow discharges.

Once a glow discharge has been initiated in a cell 150, it can be maintained by applying a low-level voltage between all the horizontal and vertical electrodes 170, 180—even after the ionizing voltage is removed. To erase a cell 150 all voltage is removed from a pair of electrodes 170, 180.

In color panels, the back of each cell 150 is coated with a phosphor material. The ultraviolet photons emitted by the plasma excite the phosphor materials, which emit visible light with colors determined by these materials.

Every pixel 160 is made up of three separate subpixel cells 151-153, each comprises different colored phosphor materials. For example, one subpixel cell 151 has a red light phosphor material, one subpixel cell 152 has a green light phosphor material and one subpixel cell 153 has a blue light phosphor material. These colors blend together to create the overall color of the pixel. Plasma panels use pulse-width modulation (PWM) to control brightness by varying the pulses of current flowing through the different cells thousands of times per second, the control system can increase or decrease the intensity of each subpixel cell color to create billions of different combinations of red, green and blue. In this way, the control system can produce most of the visible colors.

In one embodiment the plasma cell is manufactured in a semiconductor manufacturing process. In particular, the cell is manufactured in a CMOS manufacturing process.

In one embodiment the plasma cell may have a front side and/or a backside light emission. Alternatively, the cell may be arranged at an edge of a semiconductor chip, and may emit light sideways.

In one embodiment the plasma cell is formed by creating a hole in a cap layer overlying a trench, removing a sacrificial material from the trench, and closing the hole in the cap layer under rare gas atmosphere using chemical vapor deposition (CVD) or physical vapor deposition (PVD) processes.

FIGS. 2-6 show cross sectional views of several embodiments of a cell. The cells are located or are formed in a substrate or in an epitaxial layer. The substrate or epitaxial layer may be a semiconductor material such as silicon, or a compound semiconductor material such as SiGe, GaAs, InP or SiC. The substrate may comprise bulk silicon or silicon on insulator (SOI).

An opening or cavity is disposed in the substrate. The opening has sidewalls and a bottom surface. The sidewalls may be substantially orthogonal to the top surface of the substrate and the bottom surface may be substantially parallel to the top surface. Alternatively, the opening comprises curved or otherwise shaped sidewalls and no bottom surface.

An isolation or dielectric material or barrier layer may encapsulate the opening. The barrier layer may be a single layer or a stack of two or more layers. The isolation layer may comprise a first material where the isolation layer covers the bottom surface and the sidewalls of the opening and may comprise a second material where the isolation layer is the opening. The layer material may be a nitride, such as silicon nitride, an oxide, such as a silicon oxide, a carbide such as a silicon carbide, or combinations thereof. Alternatively, the isolation or dielectric material may be a metal oxide such as an aluminum oxide. The layer stack may comprise layers of different materials. The isolation or barrier layer may be 5 nm to 50 nm thick. In one embodiment the substrate may act as an isolation material itself in which case the isolation material is optional.

Electrodes are disposed adjacent to the opening. The electrodes are made from a conductive material. The conductive material may comprise poly silicon, doped silicon or combinations thereof. Alternatively, the conductive material may comprise metals such as aluminum (Al), copper (Cu), tungsten (W) or combinations thereof. The electrodes may comprise the same material or different materials.

The opening may be filled with a rare gas such as helium (He), neon (Ne), xenon (Xe), argon (Ar), other inert gases, or combinations thereof. The openings are luminous when they are electrified through electrodes.

The cells may be a stand-alone product. Alternatively, the cells may be integrated with an integrated circuit comprising semiconductor devices such as transistors, capacitors, diodes, and/or memory elements.

Figure 2A:
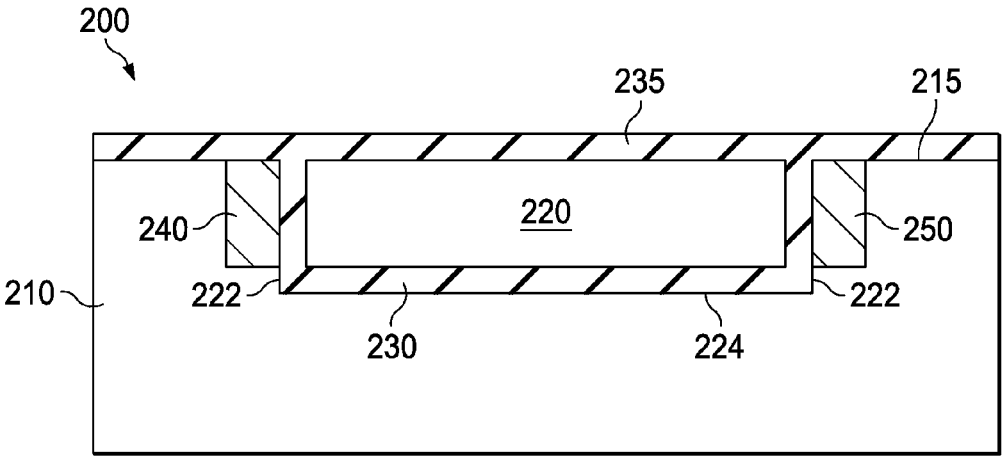
FIG. 2*a* shows a cross sectional view of an embodiment of a cell.

FIG. 2*a* illustrates an embodiment of a cell 200 where electrodes 240, 250 are disposed adjacent to the sidewalls 222. A horizontal trench 220 is disposed in the substrate 210. A barrier layer 230 is disposed along the bottom surface 224 and the sidewalls 222 of the trench 220. The barrier layer 230 may comprise a first dielectric material. The barrier layer 230 may be a good isolator for the electrodes 240, 250. For example, the barrier layer 230 may be silicon dioxide or silicon nitride. The material layer 235 is sealing the cell. The material layer 235 may be a second dielectric material. The second dielectric material may be a wavelength conversion material. For example, the second dielectric material may comprise materials such as phosphor that convert UV-light into visible light while the first dielectric material does not comprise such materials or structures. The first dielectric layer and the second dielectric layer may be comprise the same materials or different materials. For example, the barrier layer 230 may not comprise a wavelength conversion material.

The electrodes 240, 250 may be disposed next to or abutting the sidewalls 222. The electrode 240, 250 may be doped silicon, metal or silicide, for example. The electrodes 240, 250 may be disposed along the entire width and/or depth of the sidewalls 222 (see FIG. 2*f*). Alternatively, the electrodes 240, 250 have a smaller width and/or depth. The electrodes 240, 250 may comprise several smaller electrodes along the width and/or depth of the sidewalls 222.

The electrodes 240, 250 may be disposed next to or abutting the sidewalls 222, 224. The electrode 240, 250 may be doped silicon, metal or silicide, for example. The electrodes 240, 250 may be disposed along the entire width and/or depth of the sidewalls 222, 224 (see FIG. 2*f*). Alternatively, the electrodes 240, 250 have a smaller width and/or depth. The electrodes 240, 250 may comprise several smaller electrodes along the width and/or depth of the sidewalls 222, 224.

In one example, the horizontal trench 220 may be about 2 μm to about 8 μm deep and about 20 μm to about 80 μm wide. The barrier layer 230 may be about 5 nm to about 50 nm thick and the material layer 235 may be about 50 nm to about 300 nm thick.

Figure 2B:
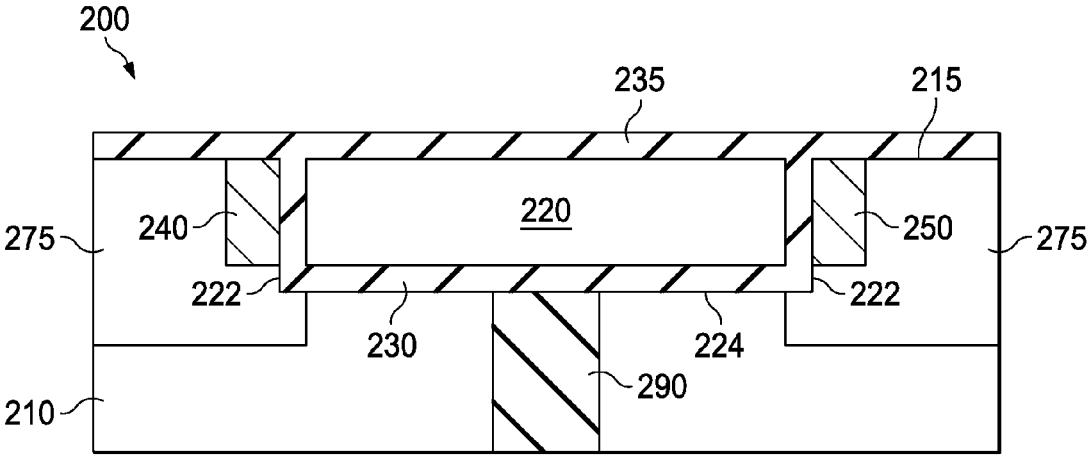
FIG. 2*b* shows an embodiment of an isolation of a cell.
Figure 2C:
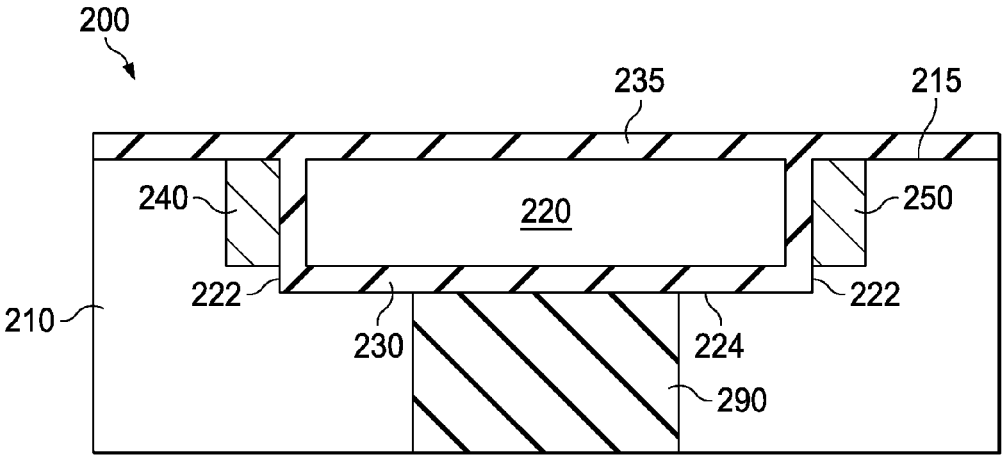
FIG. 2*c* shows another embodiment of an isolation of a cell.
Figure 2D:
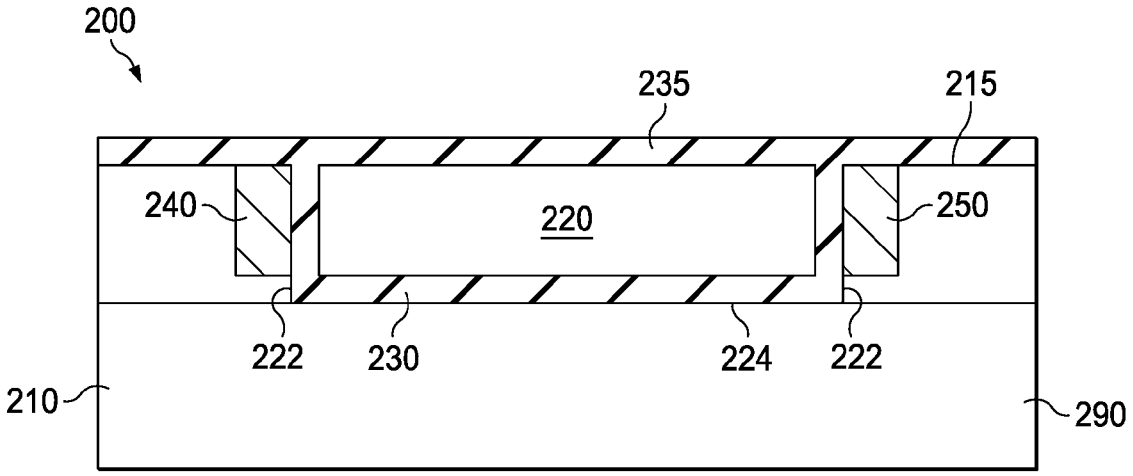
FIG. 2*d* shows yet another embodiment of an isolation of a cell.

FIGS. 2*b*-2*d* show embodiments of a cell 200 comprising an isolation region. The cell 200 of FIG. 2*b* comprises the same elements and components as the cell 200 in FIG. 2*a*. The semiconductor or compound substrate 210 may be a p-doped material with n-doped wells 275 formed therein. Alternatively, the semiconductor or compound substrate may be an n-doped material with n-doped wells 275 formed therein. The doped wells 275 may comprise a doping concentration of $10^{17}$-10-$^{19}$, for example. The optional isolation barrier 290 may be formed as deep trench isolation region before or after the opening 220 is formed. The optional isolation barrier 290 is filled with an isolation material such as silicon dioxide. For example, the isolation barrier 290 may be formed if p-doped substrate 210 is lightly doped, e.g., has a doping concentration of about $10^{12}$-$10^{14}$.

The cell 200 of FIG. 2*c* comprises the same elements and components as the cell 200 in FIG. 2*a* except that the two electrodes 240, 250 are isolated from each other by an isolation implant 290. The isolation implant 290 may comprise a low doping concentration of dopants. For example, the isolation implant 290 may be formed by implanting dopants such as boron or phosphorous in the substrate and by depleting these dopants. The isolation implant 290 may be formed before the cell 200 is formed. by doping the area with a low doping concentration The cell 200 of FIG. 2*d* comprises the same elements and components as the cell 200 in FIG. 2*a* except that the cell 200 is located in the silicon portion of the silicon on insulator substrate (SOI substrate). The insulator 290 insulates the two electrodes 240 and 250. The barrier layer 230 may or may not be a portion of the insulator 290.

Figure 2E:
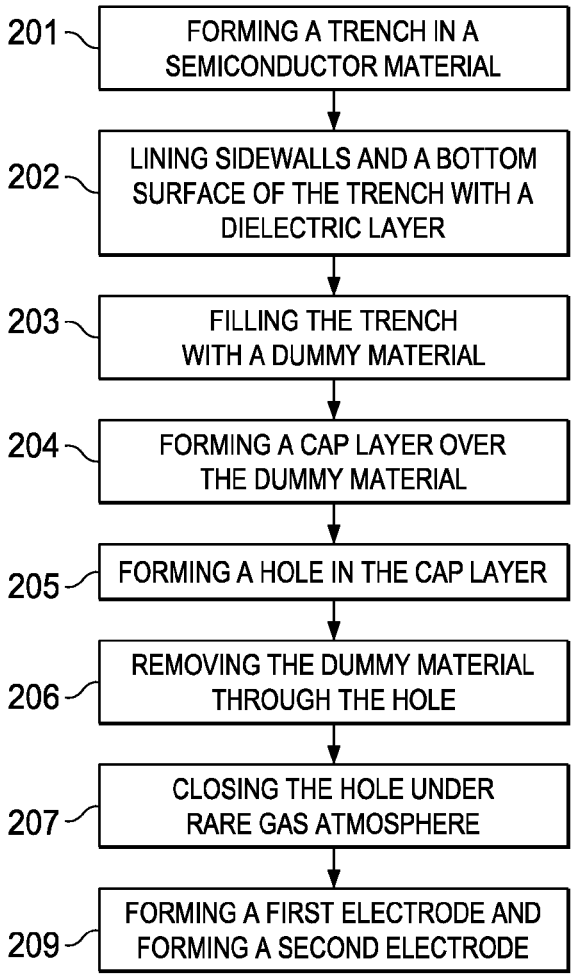
FIG. 2*e* shows a flow diagram of an embodiment of a cell.
Figure 2F:
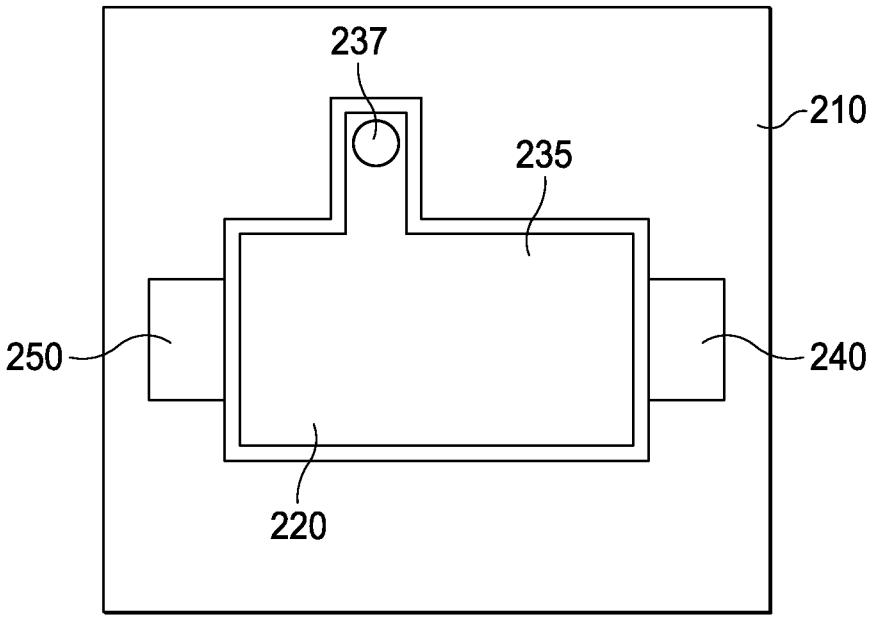
FIG. 2*f* shows a top view of an embodiment of a cell.

FIG. 2*e* shows an embodiment of a flow chart for manufacturing the cell 200. In a first step 201, a trench is formed in the substrate. The trench may be formed applying an anisotropic etch process such as a dry etch process. In the next step the bottom surface and the sidewalls of the trench is lined with a barrier layer (step 202). The trench is then filled with a sacrificial or dummy material (step 203). The sacrificial material may be a material that is different than the barrier material. The sacrificial material may have different etch characteristics and/or different etching rates than at least the barrier material. The sacrificial material may be highly selective in an etching process relative to the barrier material. The sacrificial material and the barrier layer may be planarized over a top surface of the substrate. The sacrificial material may be silicon oxide, carbon, photo resist, or photo imide. A cap layer is formed over the sacrificial material and the substrate (step 204). The sacrificial material may have different etch characteristics and/or different etching rates than the cap layer. The sacrificial material may be highly selective in an etching process relative to the cap layer. A hole or a plurality of holes are formed in the cap layer (step 205). FIG. 2*f* shows an example of a location of the hole in the cap layer. The at least one hole may be formed in a notch of the trench or in the trench itself. Next, the sacrificial material is removed from the trench through the at least one hole (step 206). The sacrificial material may be removed applying an isotropical etch process. For example, the etch chemistry applied may be diluted HF if the sacrificial material is silicon oxide, or a solvent if the sacrificial material is an organic, soluble material. After the sacrificial material is removed the at least one hole is closed (step 207). The at least one hole can be closed using a plasma chemical vapor deposition (CVD) process under rare gas atmosphere or using a physical vapor deposition (PVD) process under rare gas atmosphere. A desired pressure in the cell can be set by regulating the pressure in the CVD/PVD process. The two electrodes may be formed by doping the substrate next to trench sidewalls (208). As a skilled artisan knows, the steps can be performed in a different sequence than described herein.

During operation the cell 200 may radiate light primarily through the cap layer.

Figure 3A:
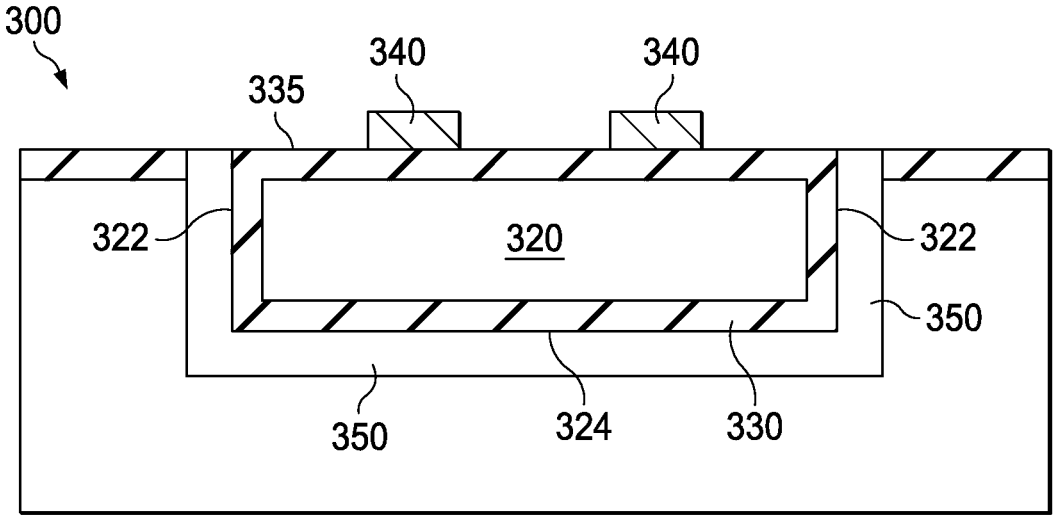
FIG. 3*a* shows a cross sectional view of an embodiment of a cell.

FIG. 3*a* shows another embodiment of a horizontal trench cell 300 configuration. Here, a top electrode 340 is disposed over a capping or sealing top surface 335 of the horizontal trench 320. The top surface 335 may be a second dielectric material. The second dielectric material may be a light wavelength conversion material. For example, the second dielectric material may comprise materials such as phosphor that convert UV-light into visible light. The top electrode 340 may comprise one electrode or a plurality of electrodes such as two or more electrodes. The top electrode 340 is isolated relative to the trench 320 and filled with the rare gas by the capping layer 335.

The bottom electrode 350 may be disposed at a bottom surface 324 of the trench 320. The bottom electrode 350 may be located at a portion of the bottom surface 324 or along the entire bottom surface 324. The bottom electrode 334 may also be located partially or entirely along the sidewalls 322 of the trench 320. The bottom electrode 350 may comprise one electrode or a plurality of electrodes such as two or more electrodes. The bottom electrode 350 is isolated relative to the trench 320 filled with the rare gas by a first dielectric layer 330. The first dielectric layer 330 and the top surface layer 335 may comprise the same material or different materials.

Figure 3B:
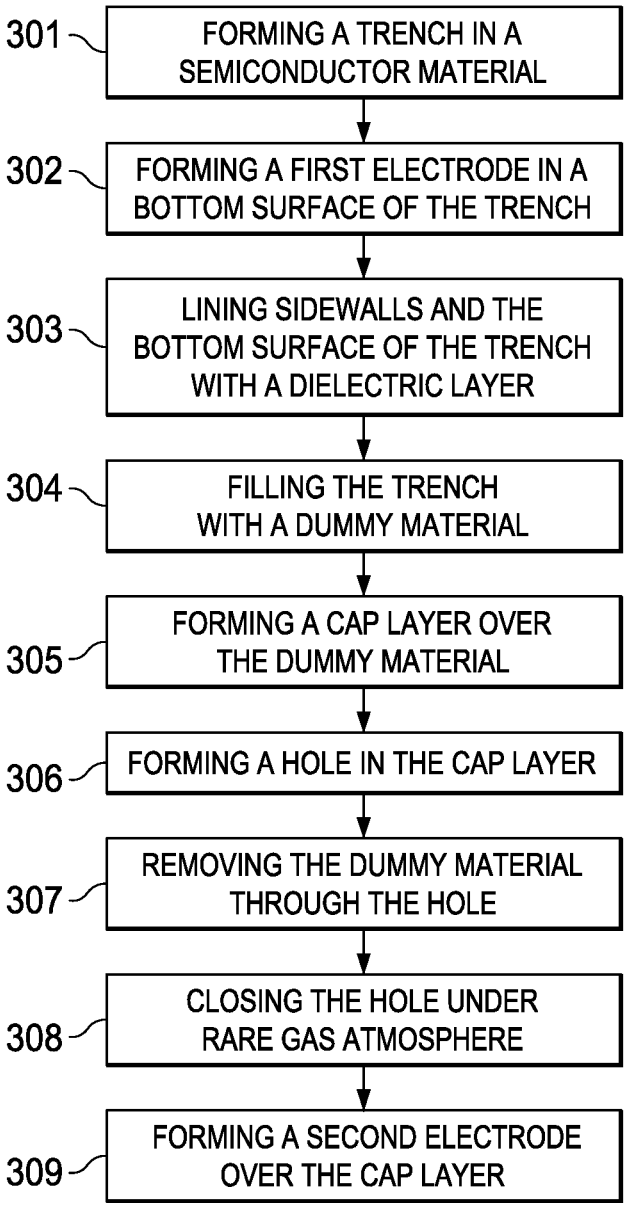
FIG. 3*b* shows a flow diagram of an embodiment of a cell.

FIG. 3*b* shows an embodiment of a flow chart for manufacturing the cell 300. In a first step 301, a trench is formed in the substrate. The trench may be formed applying an isotropic etch process such as a dry etch process. In the next step 302, the bottom electrode may be formed by doping the substrate in the bottom surface of the trench. This doping step may or may not be horizontally extended along a certain portion of the sidewalls of the trench to allow for electric contacting of the bottom electrode. Then, the bottom surface and the sidewalls of the trench are lined with a dielectric or barrier layer (step 303). Thereafter, the trench is filled with a sacrificial or dummy material (step 304). The sacrificial material may be a material that is different than the barrier material. The sacrificial material may have different etch characteristics and/or different etching rates than at least the barrier material. The sacrificial material may be highly selective in an etching process relative to the barrier material. The sacrificial material and the barrier layer may be planarized over a top surface of the substrate. The sacrificial material may be a silicon oxide, polysilicon, carbon, or, organic sacrificial material.

A cap layer may be formed over the sacrificial material and the substrate (step 305). The sacrificial material may have different etch characteristics and/or different etching rates than cap layer. The sacrificial material may be highly selective in an etching process relative to the cap layer. In step 306, a hole or a plurality of holes may be formed in the cap layer. The embodiment of the trench seen in FIG. 3*a* may have a top view similar to that of the embodiment of FIG. 2*f*. The at least one hole may be formed in a notch of the trench or in the trench itself. Next 307, the sacrificial material is removed from the trench through the at least one hole. The sacrificial material may be removed applying an isotropical etch process. For example, the etch chemistry applied may be a buffered HF to remove a silicon oxide, or, an oxygen plasma if he sacrificial material is carbon. After the sacrificial material is removed the at least one hole is closed (step 308). The at least one hole can be closed using a plasma chemical vapor deposition (CVD) process under rare gas atmosphere or using a physical vapor deposition (PVD) process under rare gas atmosphere. A desired pressure in the cell can be set by regulating the pressure in the CVD/PVD process. Finally, at step 309, a top electrode or top electrodes are formed by depositing a poly silicon, doped poly silicon or metal on the cap layer. As a skilled artisan knows, the steps can be performed in a different sequence than described herein.

Figure 4A:
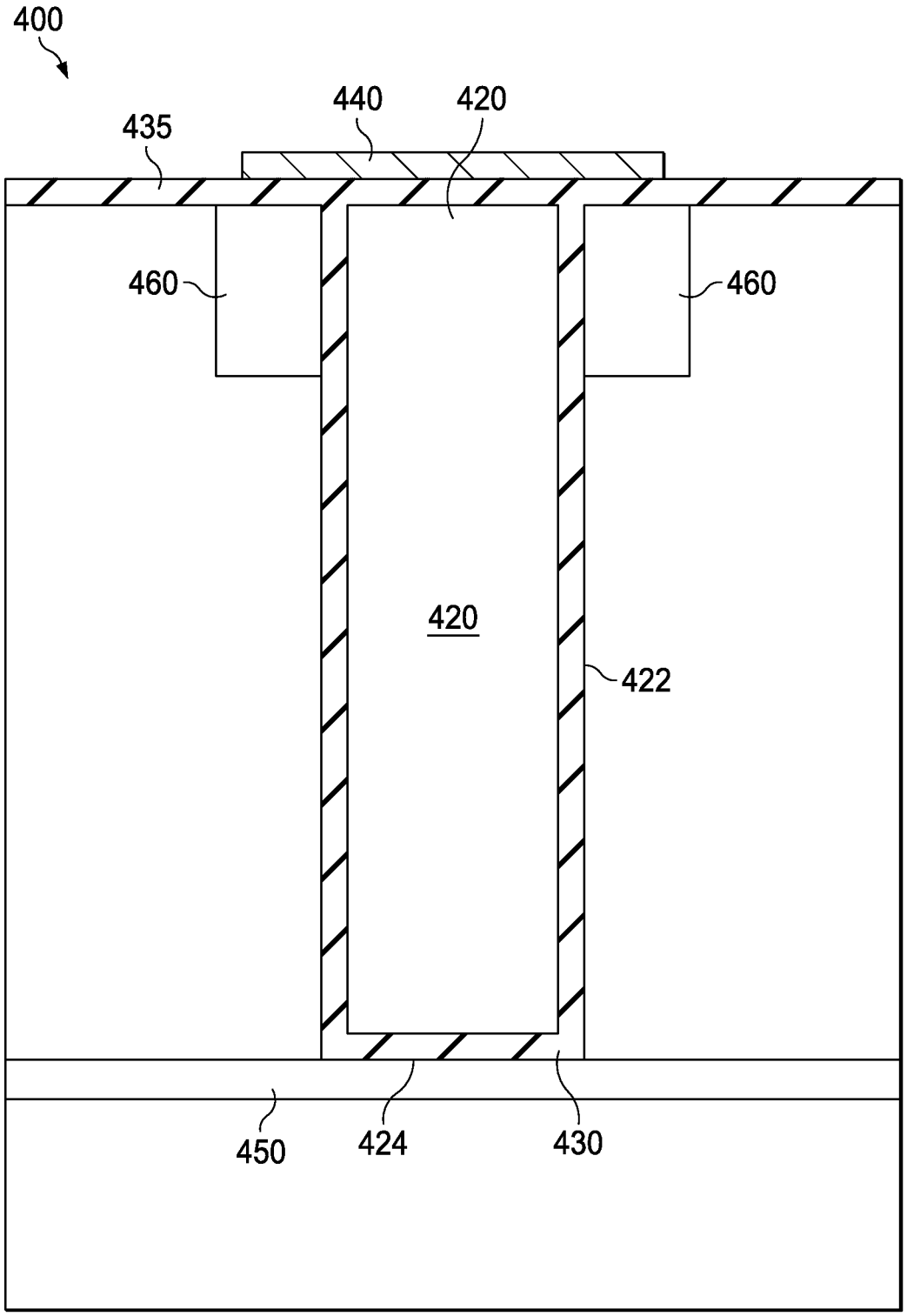
FIG. 4*a* shows a cross sectional view of an embodiment of a cell.

FIG. 4*a* shows an embodiment of a vertical trench 400 configuration. A top electrode 440 is disposed over a cap or seal layer 435 of the deep trench 420. The top electrode 440 is isolated relative to the trench 420 filled with the rare gas by the cap layer 435. The top electrode 440 may comprise one electrode or a plurality of electrodes such as two or more electrodes. The top electrode 440 may be wider than the trench 420. The bottom electrode 450 may be disposed at the bottom surface 424 of the deep trench 420. The bottom electrode 434 may be located along the bottom surface 424 and along portions of sidewalls 422 of the deep trench 420. In particular, the bottom electrode may be disposed along the bottom surface 424 and the lower portions of the sidewalls 422. The bottom electrode 450 may comprise one electrode or a plurality of electrodes such as two or more electrodes. The bottom electrode 450 is isolated relative to the trench filled with the rare gas by a barrier or dielectric layer 430. The barrier layer 430 comprises a first dielectric material. The first dielectric layer 430 and the cap layer 435 may comprise the same material or different materials. Isolation regions 460 such as shallow or deep trench isolation regions may be disposed next to the trench 420. The isolation regions 460 may comprise an insulating material such as silicon dioxide, silicon nitride, a fill material or a combination of these materials.

In one example, the deep trench 420 may be about 10 μm to about 80 μm deep and about 3 μm to about 20 μm wide. The barrier layer 430 may be about 5 nm to about 50 nm thick and the cap layer 435 may be about 30 nm to about 300 nm thick.

Figure 4B:
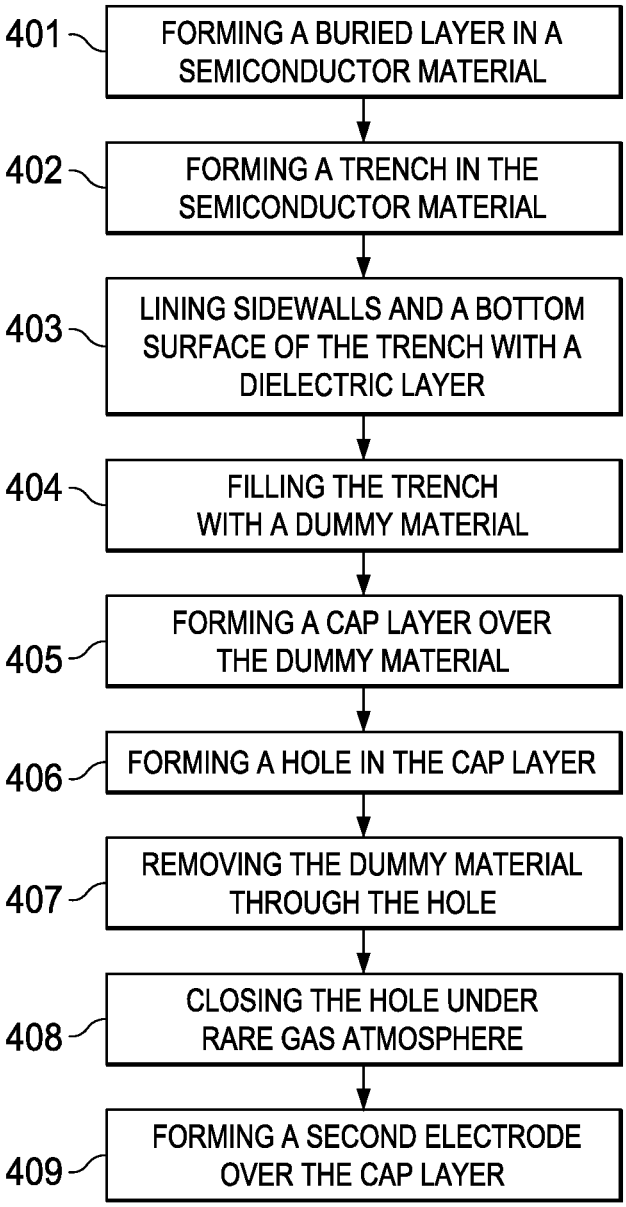
FIG. 4*b* shows a flow diagram of an embodiment of a cell.

FIG. 4*b* shows an embodiment of a flow chart for manufacturing the cell 400. In a first step 401, a buried layer is formed as a second electrode. The buried layer may be formed by epitaxial growth of a silicon layer on a substrate. The epitaxial silicon layer may be doped. Alternatively, the buried layer is formed by ion implantation in a semiconductor material substrate and a trench (step 402) is formed in the semiconductor material. The bottom surface of the trench may be adjacent or may be abutting the buried layer. The trench may be formed applying an anisotropic etch process such as a dry etch process. Then, in step 403, the bottom surface and the sidewalls of the trench are lined with a dielectric or barrier layer. The trench is then filled with a sacrificial or dummy material (step 404). The sacrificial material may be a material that is different than the barrier material. The sacrificial material may have different etch characteristics and/or different etching rates than at least the barrier material. The sacrificial material may be highly selective in an etching process relative to the barrier material. The sacrificial material and the barrier layer may be planarized over a top surface of the substrate. The sacrificial material may be silicon oxide, poly silicon, carbon, or, an organic material.

A cap layer may be formed over the sacrificial material and the semiconductive material as shown in step 405. The sacrificial material may have different etch characteristics and/or different etching rates than the cap layer. The sacrificial material may be highly selective in an etching process relative to the cap layer. A hole or a plurality of holes is formed in the cap layer (step 406). The embodiment of the trench of FIG. 4*a* may have a top view similar to that the embodiment of FIG. 2*f*. The at least one hole may be formed in a notch of the trench or in the trench itself. Next, in step 407, the sacrificial material is removed from the trench through the at least one hole. The sacrificial material may be removed applying an isotropic etch process. For example, the etch chemistry applied may be buffered HF if the sacrificial material is silicon oxide. After the sacrificial material is removed the at least one hole is closed (step 408). The at least one hole can be closed using a plasma chemical vapor deposition (CVD) process under rare gas atmosphere or using a physical vapor deposition (PVD) process under rare gas atmosphere. A desired pressure in the cell can be set by regulating the pressure in the CVD/PVD process. Finally, at step 409, a top electrode or the top electrodes are formed by depositing a poly silicon, doped poly silicon, or, metal on the cap layer. Isolation regions such as shallow trench isolations (STIs) may be formed next to the trench. The STIs can be formed before the trench is formed or after the trench is formed. As a skilled artisan knows, the steps can be performed in a different sequence than described herein.

Figure 5A:
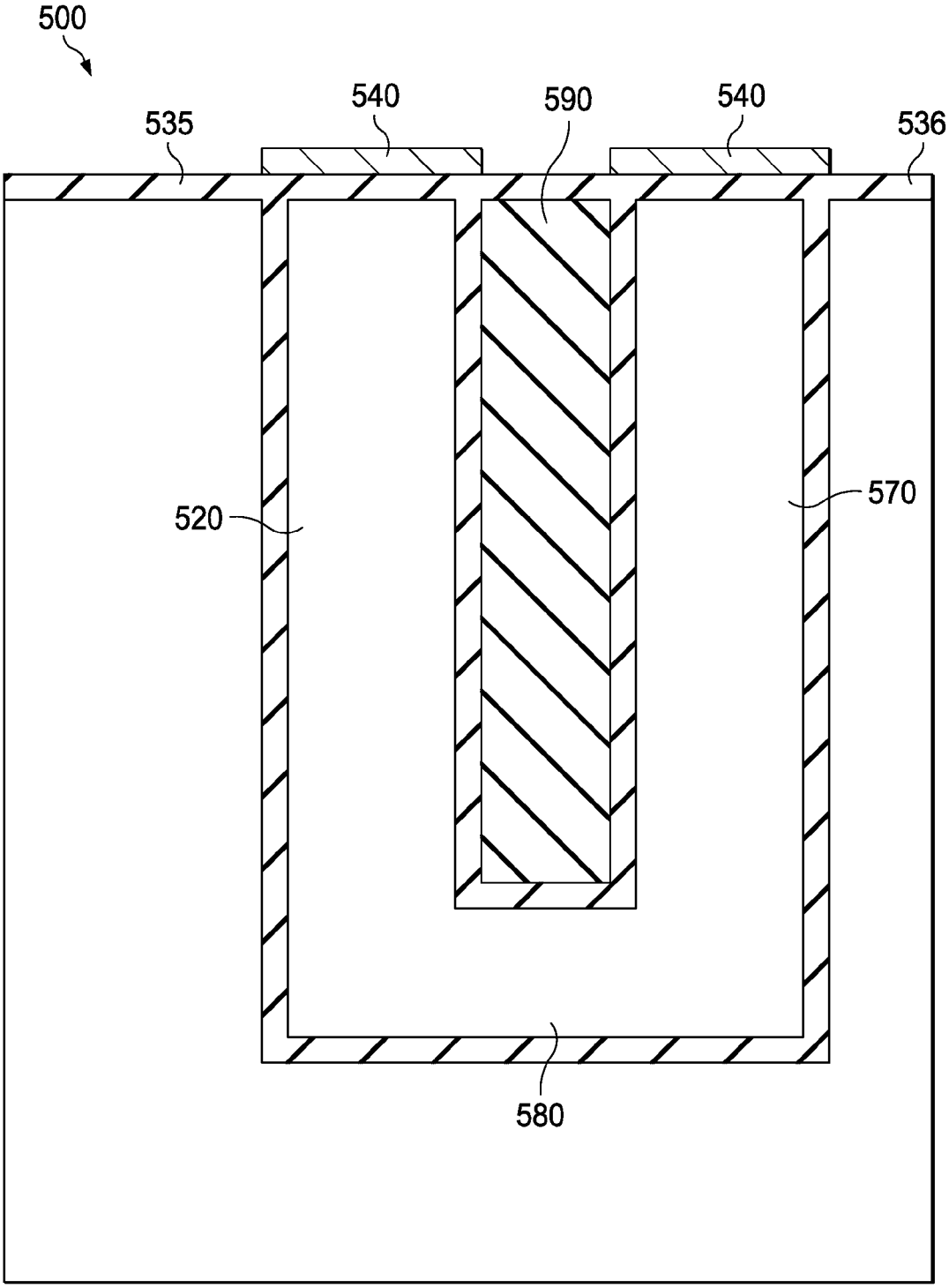
FIG. 5*a* shows a cross sectional view of an embodiment of a cell.

FIG. 5*a* shows an embodiment of a coplanar U-shaped trench structure 500. The U-shaped trench structure 500 may comprise a first trench 520 and a second trench 570 which are connected to each other through a connection 580. The first trench 520 may be a horizontal or deep trench and the second trench 570 may be a horizontal or deep trench. A first electrode 540 is disposed over a first cap layer 535 of the first trench 520 and a second electrode 550 is disposed over a second cap layer 536 of the second trench 570. The first cap layer 535 and the second cap layer 536 may be different or may be the same. The first electrode 540 may overlie the entire width of the first trench 520 and/or the second electrode 550 may overlie the entire width of the second trench 570. The first electrode 540 may comprise the same material or a different material than the second electrode 550. The first and the second electrodes 540, 550 may comprise one electrode or a plurality of electrodes such as two or more electrodes.

The two trenches 520, 570 may be isolated against each other by a deep trench isolation region 590. Alternatively, the isolation region 590 may be a shallow trench isolation region. The isolation region 590 may comprise an insulating material such as silicon dioxide, silicon nitride, a high-k material, a fill material or a combination of these materials. Optionally, shallow trench isolation regions may be disposed on the outer side of each trench 520, 570.

A barrier layer 530 is disposed along the bottom surface and the sidewalls of the U shaped trench 520, 570, 580. The barrier layer 530 may comprise a dielectric material with or without wavelength conversion characteristics. The barrier layer 530 may comprise the same material or different materials than the cap layers 535, 536.

Figure 5B:
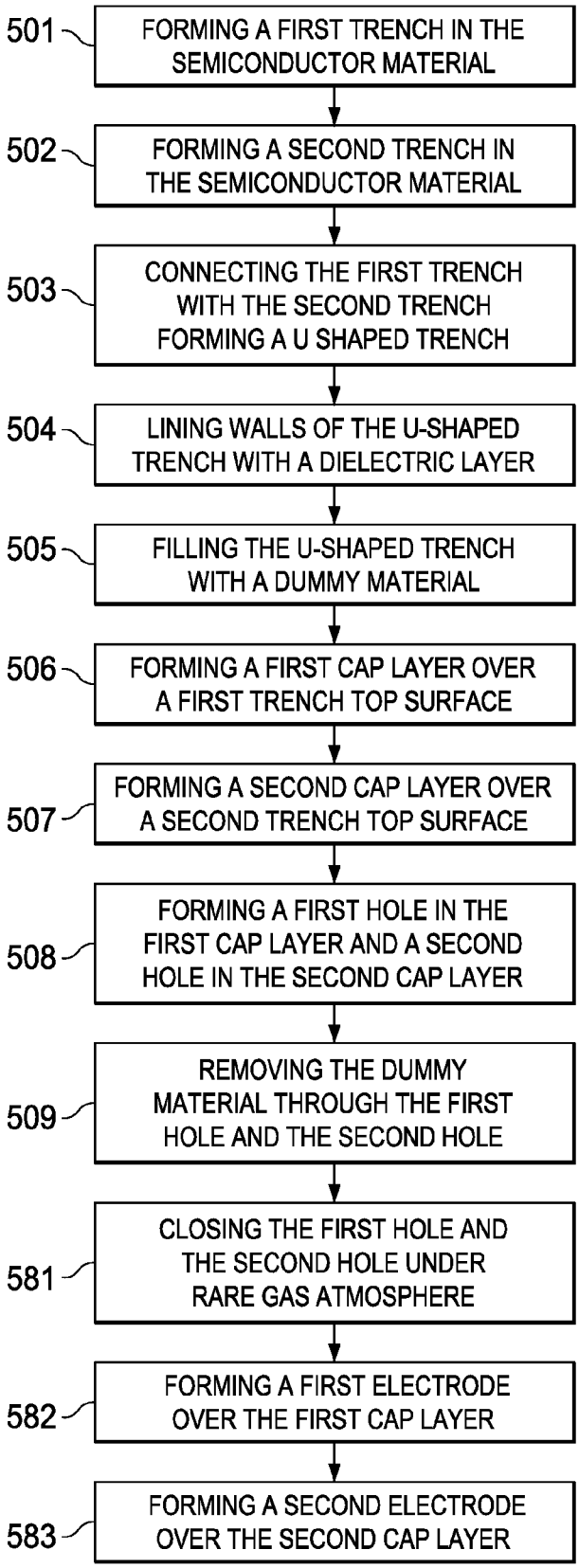
FIG. 5*b* shows a flow diagram of an embodiment of a cell.

FIG. 5*b* shows an embodiment of a flow chart for manufacturing the U-shaped coplanar cell 500. A first trench may be formed in a first step 501 in the substrate and a second trench may be formed in a second step 502. The first and second trenches may be formed applying an anisotropic etch process such as a dry etch process. In one embodiment, the trenches are etched in a two-step process: First, the trenches are etched first to a first depth forming a first trench region and the sidewalls are passivated by forming a silicon oxide or depositing a silicon nitride. Second, the trenches are then further etched with an anisotropic etch process increasing the trench depth forming a second lower trench region. The trench depth may be further increased by a 1 μm to 10 μm. The sidewalls of the second trench region are not passivated. Finally, the two trenches are connected in the second lower trench region where the sidewalls are not passivated. The two trenches are connected by a Venetia process (anneal in a hydrogen environment) forming the U-shaped trench (step 503). Alternatively, this connection can be accomplished by an etch process with an isotropic component.

Then, at step 504, the U-shaped trench surfaces are lined with a dielectric or barrier layer. This can be accomplished by oxidation of the silicon. Next, at step 505, the U-shaped trench is then filled with a sacrificial or dummy material. It is noted that the trench does not need to be completely filled with the sacrificial material. It is sufficient that the sacrificial material completely closes the trench opening near the top surface. The sacrificial material may be a material that is different than the barrier material. The sacrificial material may have different etch characteristics and/or different etching rates than at least the barrier material. The sacrificial material may be highly selective in an etching process relative to the barrier material. The sacrificial material and the barrier layer may be planarized over a top surface of the substrate. The sacrificial material may be poly silicon, carbon, silicon oxide, or, organic material. Next, in steps 506 and 507, a first cap layer is formed over the sacrificial material in the first trench and a second cap layer is formed over the sacrificial material in the second trench. The first cap layer and the second cap layer may comprise the same material or different materials. The sacrificial material may have different etch characteristics and/or different etching rates than the cap layer. The sacrificial material may be highly selective in an etching process relative to the cap layer. A hole or a plurality of holes may be formed in each cap layer (step 508). The trench in embodiment FIG. 5*a* may have a top view similar to that in the embodiment of FIG. 2*f*. The at least one hole may be formed in a notch of the first trench and/or second trench or in the trench itself. Next, the sacrificial material is removed from the trench through the at least one hole. The sacrificial material may be removed applying an isotropical etch process (step 509). For example, the etch chemistry applied may be an organic solvent if an organic material is used as a sacrificial material.

Next, in step 581, after the sacrificial material is removed the at least one hole is closed. The at least one hole can be closed using a plasma chemical vapor deposition (CVD) process under rare gas atmosphere or using a physical vapor deposition (PVD) process under rare gas atmosphere. A desired pressure in the cell can be set by regulating the pressure in the CVD/PVD process. The chosen pressure and gas mix allows the operation of the manufactured plasma cell. In step 582, the first top electrode or the first top electrodes are formed by depositing a polysilcion, doped polysilicon or metal on the first cap layer. Finally, in step 583, the second top electrode or the second top electrodes are formed by depositing a polysilcion, doped polysilicon or metal on the second cap layer. As a skilled artisan knows, the steps can be performed in a different sequence than described herein.

An isolation region between the trenches of the U-shaped trench is formed. The isolation region is a deep trench isolation region in some embodiments. Alternatively, the isolation region is a shallow trench isolation. The isolation region may be formed before the trench is formed or after the trench is formed. In one embodiment, the isolation region may be formed in the anisotropic etch forming the trenches. In this case, the width of the isolation region is smaller than the width of the trenches. The etch depth may be reduced for the isolation reduced compared to the depth of the trenches.

Shallow trench isolation regions may be formed surrounding the U-shaped trench. Again, the trench isolation region surrounding the U-shaped trench can be formed at the same time as the isolation region between the trenches of the U-shaped trench is formed or at different times.

Figure 6A:
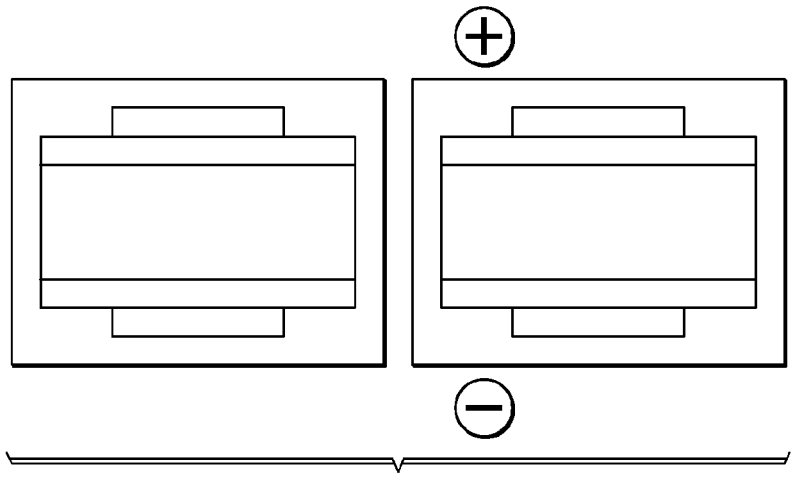
FIGS. 6*a*-6*c* shows an operation method of the cell.
Figure 6B:
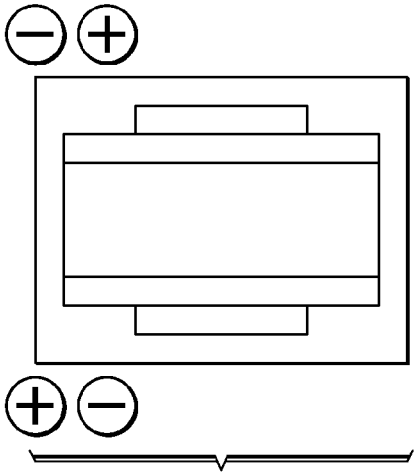
Figure 6C:
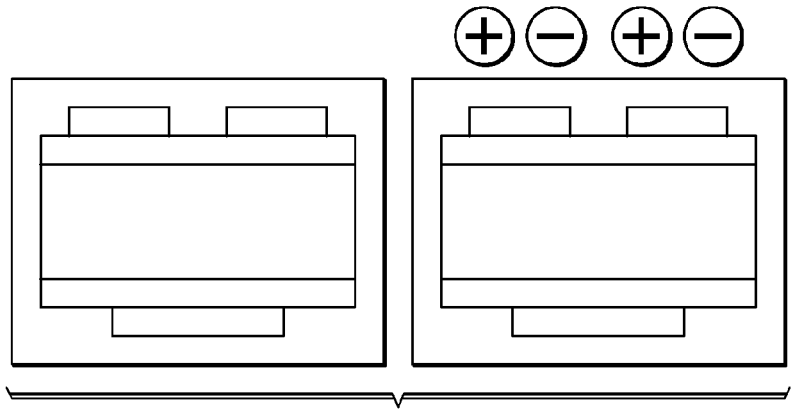

FIGS. 6*a*-6*c* show operation methods of a plasma cell. The cell can be in an ON state or in an OFF state. The cell is in an ON state when there is a discharge and in an OFF state when there is no discharge.

In one embodiment the cell 600 may be operated with an AC voltage. Initially, a firing voltage pulse sets the ON state and sustain voltage pulses maintain the ON state (see FIGS. 6*a*-6*b*). The firing voltage pulse, which is higher than the sustain voltage pulses, initiate a discharge. The cell 600 continues to discharge when the sum of the sustain voltage, which is lower than the firing voltage and the wall voltage exceeds the discharge voltage. FIG. 6*a* shows the cell 600 in a firing mode. In a first half cycle, a firing potential is applied between the top electrode 610 and the bottom electrode 620 and a wall voltage 625 having reverse potential is created at the bottom electrode 620. Referring now to FIG. 6*b*, in a second half-cycle, the potential is reversed and a potential with a sustain voltage is applied. Now, the sum of the wall voltage and a first sustain voltage pulse exceeds the discharge voltage and fires the cell 600. A wall voltage 615 is created at the top electrode 610. In a next half-cycle, the sustain potential is reversed and the sum of the wall voltage and a second sustain voltage pulse exceeds the discharge voltage. A wall voltage 625 is created at the bottom electrode 620. This process can continue until it is stopped.

FIG. 6*c* shows an embodiment of a mode of operation where the first top electrode 610 starts the process and a wall voltage 635 is created at the second top electrode 630. Then, the voltage is reversed, the cell is fired again and a wall voltage 615 is created at the first top electrode 610. The process continues until it is stopped. The bottom electrode 640 is at a fixed potential, for example, at ground potential. The operation frequency may be between about 100 kHz and about 500 kHz. Alternatively, other frequencies may be used.

Although the present invention and its advantages have been described in detail, it should be understood that various changes, substitutions and alterations can be made herein without departing from the spirit and scope of the invention as defined by the appended claims.

Moreover, the scope of the present application is not intended to be limited to the particular embodiments of the process, machine, manufacture, and composition of matter, means, methods and steps described in the specification. As one of ordinary skill in the art will readily appreciate from the disclosure of the present invention, processes, machines, manufacture, compositions of matter, means, methods, or steps, presently existing or later to be developed, that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A cell comprising:

a semiconductor material;

an opening disposed in the semiconductor material;

a dielectric layer lining a surface of the opening;

a cap layer closing the opening;

a first electrode disposed adjacent the opening; and a second electrode disposed adjacent the opening, wherein the surface of the opening comprises a first sidewall, a second sidewall and a bottom surface, and wherein the first electrode is disposed at the first sidewall and the second electrode is disposed at the second sidewall.

2. The cell according to claim 1, wherein the first electrode and the second electrode are disposed on opposite sides of the opening.

3. The cell according to claim 1, further comprising an inert gas disposed in the opening.

4. The cell according to claim 1, wherein the opening comprises a horizontal trench or a deep trench.

5. The cell according to claim 1, further comprising an integrated circuit.

6. The cell according to claim 1, wherein the first electrode is embedded in a first well and wherein the second electrode is embedded in a second well.

7. The cell according to claim 6, wherein the first and second wells are doped with elements of a first conductivity type, and wherein semiconductor substrate is doped with elements of a second conductivity type, the first conductivity type being different than the second conductivity type.

8. A panel comprising:
a semiconductor material; and
a plurality of cells, each cell comprising:
an opening disposed in the semiconductor material, wherein the opening comprises a U-shaped trench;
a dielectric layer lining a surface of the opening;
a cap layer sealing the opening;
a first electrode disposed adjacent the opening; and
a second electrode disposed adjacent the opening.

9. The panel according to claim 8, wherein each cell further comprises an inert gas disposed in the opening.

10. The panel according to claim 8, wherein the first electrode and the second electrode of each cell are disposed on a same side of the opening.

11. The panel according to claim 8, further comprising an integrated circuit.

12. A method for manufacturing a semiconductor device, the method comprising:
forming an opening in a semiconductor material;
lining the opening with a dielectric layer;
closing the opening with a cap layer, wherein closing the opening comprises:
filling the opening with a sacrificial material;
forming the cap layer over the sacrificial material;
forming a hole in the cap layer; and
removing the sacrificial material through the hole;
forming a first electrode adjacent the opening; and
forming a second electrode adjacent the opening.

13. The method according to claim 12, wherein closing the opening with the cap layer further comprise closing the hole through a CVD process or a PVD process under a rare gas atmosphere.

14. The method according to claim 12, wherein forming the first electrode and/or forming the second electrode comprises doping the semiconductor material.

15. The method according to claim 12, wherein forming the first electrode and/or the second electrode comprises depositing a polysilicon, a doped polysilicon, or a metal on the cap layer.

16. The method according to claim 12, further comprising forming an shallow trench isolation region next to the opening.

17. The method according to claim 12, wherein the first electrode and the second electrode are disposed on opposite sides of the opening.

18. The method according to claim 12, wherein the first electrode and the second electrode are disposed on the same side of the opening.

19. The method according to claim 12, wherein a surface of the opening comprises a first sidewall, a second sidewall, and a bottom surface, and wherein the first electrode is disposed on the cap layer and the second electrode is disposed at the bottom surface.

20. A cell comprising:
a semiconductor material;
an opening disposed in the semiconductor material, wherein the opening comprises a U-shaped trench;
a dielectric layer lining a surface of the opening;
a cap layer closing the opening;
a first electrode disposed adjacent the opening; and
a second electrode disposed adjacent the opening.

21. The cell according to claim 20, wherein the first electrode and the second electrode are disposed on the same side of the opening.

22. A cell comprising:
a semiconductor material;
an opening disposed in the semiconductor material;
a dielectric layer lining a surface of the opening;
a cap layer closing the opening;
a first electrode disposed adjacent the opening; and
a second electrode disposed adjacent the opening, wherein the opening comprises a first trench having first sidewalls and a second trench having second sidewalls, wherein the first trench is connected to the second trench, wherein the first electrode is disposed over a top surface of the first trench and the second electrode is disposed over a second top surface of the second trench, and wherein an isolation region is disposed between the first trench and the second trench.

23. A method for manufacturing a semiconductor device, the method comprising:
forming an opening in a semiconductor material;
lining the opening with a dielectric layer;
closing the opening with a cap layer;
forming a first electrode adjacent the opening; and
forming a second electrode adjacent the opening, wherein forming the first electrode and/or forming the second electrode comprises doping the semiconductor material.

24. The method according to claim 23, wherein closing the opening with the cap layer further comprise closing a hole in the cap layer through a CVD process or a PVD process under a rare gas atmosphere.

25. The method according to claim 23, wherein the first electrode and the second electrode are disposed on opposite sides of the opening.

26. The method according to claim 23, wherein a surface of the opening comprises a first sidewall, a second sidewall, and a bottom surface, and wherein the first electrode is disposed on the cap layer and the second electrode is disposed at the bottom surface.

* * * * *